United States Patent [19]

Bardsley

[11] 4,303,025

[45] Dec. 1, 1981

[54] TUFTING MECHANISM FOR FORMING LOW PILE

[75] Inventor: Harold B. Bardsley, near Chorley, England

[73] Assignee: Spencer Wright Industries, Inc., Chattanooga, Tenn.

[21] Appl. No.: 212,316

[22] Filed: Dec. 3, 1980

[30] Foreign Application Priority Data

Dec. 14, 1979 [GB] United Kingdom ..... 43249/79

[51] Int. Cl.[3] ..... D05C 15/00

[52] U.S. Cl. ..... 112/79 R

[58] Field of Search ..... 112/79 R, 79 A, 79 FF

[56] References Cited

U.S. PATENT DOCUMENTS 4,193,359 3/1980 Beasley ..... 112/79 R

*Primary Examiner*—Ronald Feldbaum

*Attorney, Agent, or Firm*—Alan Ruderman

[57] ABSTRACT

A cut pile tufting machine having needle plate backing support fingers oscillated in timed relationship with the hooks and the needles of the machine to support the backing material during needle penetration and to withdraw from the needle path as the hooks move across the needle path to seize loops. The needle plate is mounted on a rocker arm carried by a common rock shaft with the rocker arm on which the hooks are mounted so that the needle plate together with the fingers oscillate in opposition to the oscillation of the hooks. As the hooks move toward the needle center line the fingers move away and as the hooks move away from the needle center the fingers move toward the needle center line.

11 Claims, 4 Drawing Figures

TUFTING MECHANISM FOR FORMING LOW PILE

BACKGROUND OF THE INVENTION

This invention relates to tufting machines and more particularly to tufting machines for producing minimal pile height cut pile fabrics.

In conventional tufting machines an oscillating looper or hook cooperates with a reciprocating needle to form loops at the reverse side of the backing material penetrated by the needle. The fabric is supported by fingers extending forwardly from a needle plate and the needles pass between the fingers. In the production of loop or uncut pile the loops formed are released by the loopers and are drawn back toward the backing material by the needle. Thus, in general the height of the loops of uncut pile can be controlled to a very low or minimal height. In the production of cut pile fabric, however, the loops are not released by the barbed loopers or hooks, but remain thereon and are cut by an oscillating knife cooperating with each hook. At the loop seizing position the barb at the free end of the hook passes beneath the needle plate fingers so that the height of the backing material above the cutting edge of the hook, and thus the pile height, is determined by the geometry of both the hooks and the needle plate fingers.

The limitations imposed on the minimum pile height by the thickness dimensions of the fingers and barb are of relatively little consequence with regard to tufted fabric produced for use as floor coverings. However such limitations are of relevance in the context of machinery for use in the manufacture of ultra-low pile fabrics such as for upholstery fabrics, where the pile heights may be in the order of just a few millimeters.

In Beasley U.S. Pat. No. 4,193,359 a tufting machine is provided in which the bills of the hooks are arranged at substantially the same level as the needle plate fingers so as to produce low pile fabric. The pile height produced by this proposal, however, is limited since the base material still rests on the needle plate fingers and the pile height produced has a dimension substantially equivalent to the top of the needle plate fingers to the cutting edge of the hook.

SUMMARY OF THE INVENTION

The primary object of the present invention is to provide an arrangement wherein the pile height limitations imposed by the geometry of existing structures are avoided.

It is another object of the present invention to provide a method and apparatus for attaining a low pile height on a cut pile tufting machine without imposing geometric restrictions on the hooks and the needle plate fingers.

It is a further object of the present invention to provide a tufting machine having moveable needle fingers, the fingers supporting the backing material during penetration of the needles and withdrawing from the needle path as the hooks move into loop seizing engagement with the needles.

It is a still further object of the present invention to provide a tufting machine having needle plate support fingers oscillating in conjunction with the motion of the hooks and needles so that the fingers support the backing material during needle penetration and withdraw from between the needles as the hooks enter the loop seizing position with the needles.

According to the present invention there is proposed a tufting machine wherein the needle plate fingers are adapted to be displaced out of the path of movement of the needles and hooks when support of the backing material against penetration forces is no longer needed.

By providing for the withdrawal of the needle plate fingers from the path of movement of the needles after the fingers have fulfilled their intended function of supporting the backing material during penetration of such material by the needles, a path of movement for the hooks which lies at or closely adjacent to the opposing face of the backing material in register with the respective points of penetration is made available, and accordingly the distance of the cutting edge or underside of the bill of the hook from such opposing face, and hence the dimensions of the loop to be formed, can be determined by reference only to the geometry of the bill and the disposition and movement of the hook.

The displacement of the needle plate fingers may involve a linear movement of the fingers in a direction generally perpendicular to the path of movement of the reciprocating needles or such displacement may be by way of a pivotal movement of the fingers. Indeed, a combination of both linear and pivotal movements may be found particularly convenient.

In accordance with the principles of the present invention the needle plate together with the fingers are oscillated in timed relationship with the hooks and needles to support the backing material during needle penetration and to withdraw from the plane of needle reciprocation as the hooks move across the needles to seize loops therefrom. To this end the needle plate may be mounted on a rocker arm oscillated in substantial opposition to the oscillation of the hooks. Preferably the needle plate rocker arm may be mounted on a common rock shaft with the rocker arm that drives the hook bar and thus the hooks. Additionally, the needle plate and the hook bar rocker arms may be linked together rigidly to insure a positive drivingly timed relationship.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
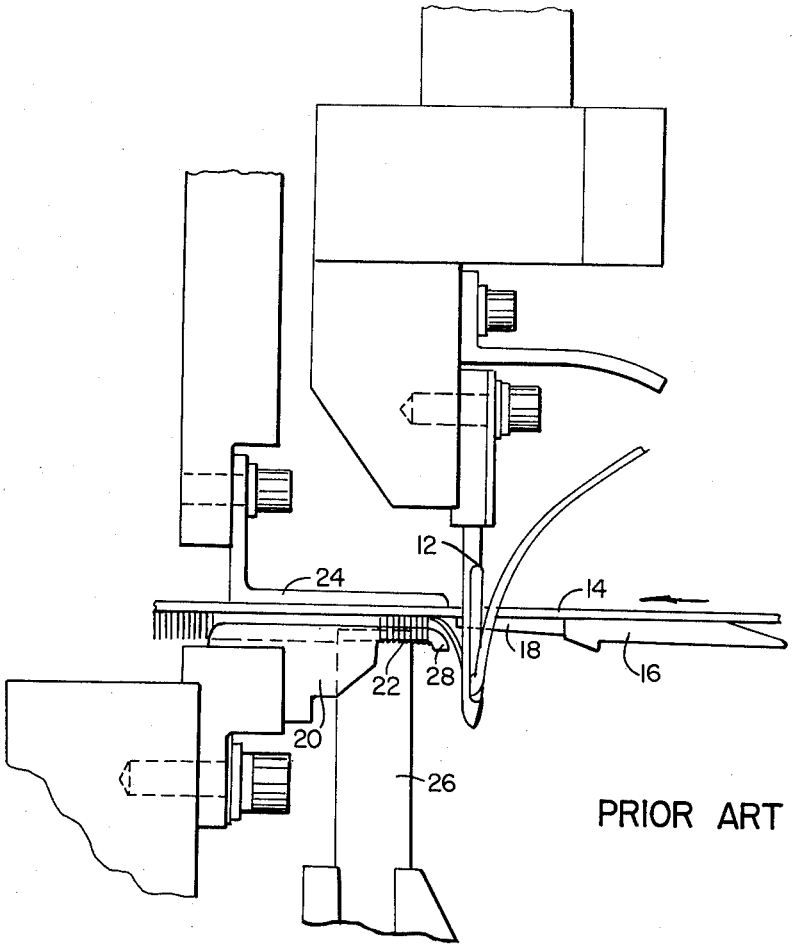
FIG. 1 is a diagrammatic side elevational view of the tuft-forming instrumentalities of a tufting machine incorporating prior art needle plate fingers.

Referring now to the drawing, and more particularly to FIG. 1 thereof, the tuft-forming instrumentalities of a conventional tufting machine comprise a multiplicity of needles 12 reciprocable perpendicularly of and through a backing material 14 supported on a needle plate 16, the needles 12 passing during penetration between adjacent ones of fingers 18 extending forwardly of the front edge of the needle plate 16. After penetration of the fabric the needles cooperate with respective oscillating hooks 20 in the bed at the underside of the backing material. As is conventional, the hooks are adapted to engage the needles 12 and seize loops 22 formed thereby and to hold the loops as the needles withdraw from the backing.

A presser foot 24 is provided at that side of the backing fabric 14 remote from the hooks 20 and in overlying disposition relative to such hooks, the presser foot 24 serving to support the fabric 14 during needle withdrawal, while a respective knife 26 is provided for cooperation with each hook 20 to cut loops seized and retained on such hook and moving rearwardly thereof into the path of movement of the respective knife 26 as the backing material advances in the direction of the arrow.

Although a single needle/hook/knife combination is shown in the drawing, but it is to be understood that a multiplicity of such combinations exists in side-by-side disposition across the tufting machine.

In the conventional tufting machine shown in FIG. 1 the forwardly extending fingers 18 of the needle plate 16 and set at a higher level than the hooks 20 in order that, during their oscillating movement, the forward ends, or bill 28 of the hooks will pass below the fingers 18 without interference. As will readily be appreciated, with the prior art arrangement, the minimum pile height which can be attained is determined, at least in part, by the height of the backing material 14 above the cutting edge of the hook 20, and such height is necessarily determined by the relevant dimensions of needle plate fingers 18 and hook 20 in combination.

In order to provide for the possibility of producing fabrics having pile heights of a dimension less than that possible with the conventional arrangement, it is proposed, in accordance with the present invention, that the needle plate fingers support the backing material in the region of the needles only during needle penetration, and that the fingers are withdrawn from such region as the hooks move forward into cooperative engagement with the needles.

Figure 2:
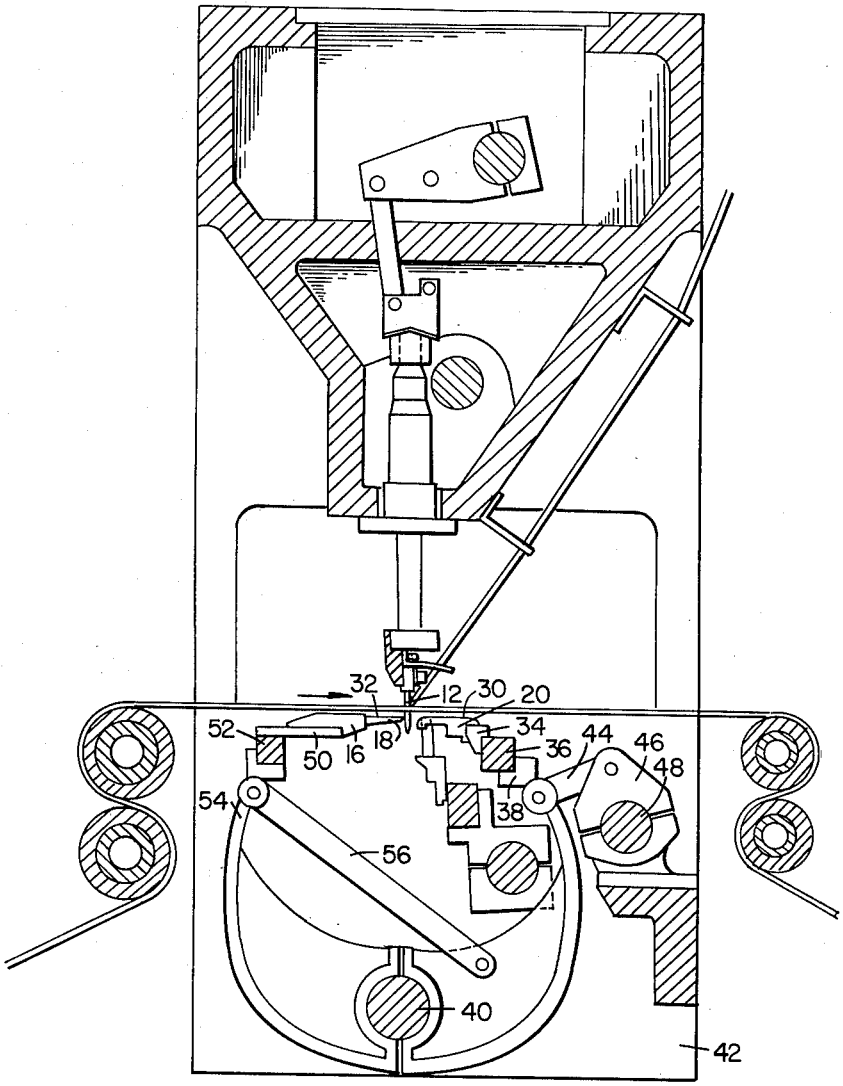
FIG. 2 is a cross sectional view taken substantially through the bed of a tufting machine incorporating the principles of the present invention.

Thus, with reference to FIG. 2, the needle plate 13, in contradistinction to prior art arrangements, is mounted for reciprocal motion towards and away from the plane of the axes of the needles 12 in synchronism with the cyclic movement of the tuft-forming instrumentalities. The forwardly extending fingers are withdrawn from the path of the hooks as the hooks move into cooperative engagement with the needles. Moreover, the hooks 20 are so positioned in relation to the backing material 14 that the upper edges 30 thereof are approximate to the plane of the support surface 32 of the needle plate 16.

The hooks 20 may be conventionally mounted in hook bars 34 carried by a mounting bar 36 secured to the upper end of a rocker arm 38. Any conventional means to oscillate the arm 38 may be provided. In the preferred embodiment the lower end of the rocker arm 38 is clamped to a laterally extending rock shaft 40 journalled in the bed 42 of the tufting machine. Pivotably connected to the upper portion of the rocker arm 38 is one end of a connecting link 44 having its other end pivotably connected between forked arms of a jack shaft rocker arm 46. The arm 46 is clamped to a jack shaft 48 which has oscillating motion imparted thereto by conventional drive means in timed relationship with the reciprocation of the needles 12. The needle plate 16 may be secured to an elongated plate 50 which in turn may be supported on a bar 52 attached to the upper end of a second rocker arm 54. Although any convenient means to oscillate the arm 54 in timed relationship with the arm 38 may be provided, in the preferred embodiment the lower end of the rocker arm 54 is clamped to the rock shaft 40 in a manner similar to the rocker arm 38. Consequently, as the jack shaft 48 oscillates to rock the rocker arm 38 together with the rock shaft 40 the rocker arm 54 is also oscillated so that the needle plate 16 together with the fingers 18 oscillate in opposition to the oscillation of the hooks. To insure a positive drive connection between the rocker arms 38 and 54 a link 56 may be provided rigidly connecting the two rocker arms together.

Figure 3:
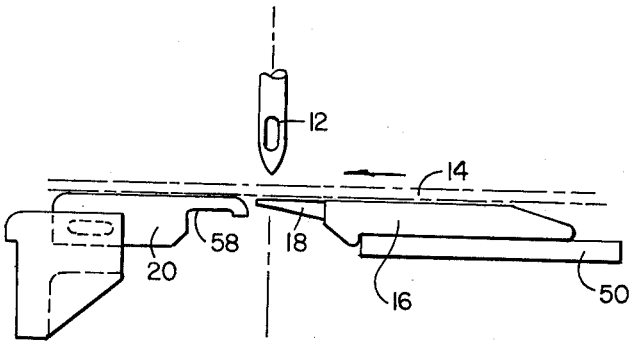
FIG. 3 is a diagrammatic side elevational view of a portion of the tuft-forming instrumentalities of the tufting machine depicted in FIG. 2 just prior to the needle penetration position.
Figure 4:
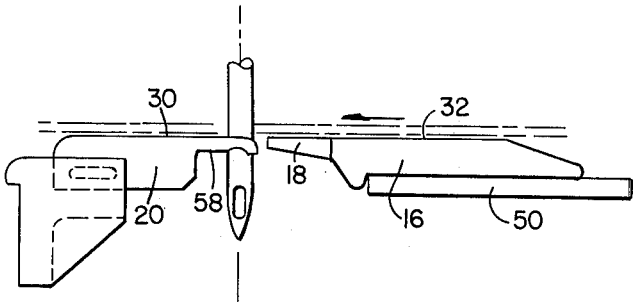
FIG. 4 is a diagrammatic side elevational view similar to FIG. 3 but illustrating the parts in the loop seizing position.

With reference to FIGS. 3 and 4 it will be understood that as the needles 12 reciprocate downwardly for penetration into the backing material 14 the needle plate 16 together with the fingers 18 are in a disposition such that the fingers 18 are disposed in the plane of needle reciprocation to support the backing material as the needle penetrates therethrough. However, as the hook 20 oscillates toward loop seizing engagement with the needle the needle plate 16 together with the fingers oscillate away from the plane of needle reciprocation as depicted in FIG. 4. The fingers thusly move from the path of needle reciprocation after they have fulfilled their intended function of supporting the backing material during the penetration of such material by the needles.

As will readily be appreciated, the minimum pile height will be determined by the spacing of the cutting edge 58 of the hook 20 from the backing material 14 and will, therefore be determined by the dimension of the hook 20 in a direction generally perpendicular to the backing material 14. The minimum pile height thus will be independent of the dimensions of the needle plate fingers 18 in such direction.

Of course, it may be found desirable to arrange for the position of the hooks 20 relative to the position of the backing material 14 to be adjustable, thus to provide for the possibility of producing tufted fabrics of a selected one of a range of pile heights. This facility for adjustment may require hooks of different sizes or "heights" consistent with pile height requirements.

As an alternative to oscillatory motion of the hooks, as in conventional fashion, the hooks may be caused to execute a substantially linear reciprocal motion in step with the motion of the needle plate.

The invention is of particular application to the context of the manufacture of upholstery fabrics, and it is believed that pile heights of the order of 2 mm are attainable by means of the invention.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims. Thus, for example, instead of mounting the needle plate for linear motion towards or away from the path of movement of the needles as in the embodiment disclosed, it may be found more convenient, in some instances, to mount the needle plate for pivotal motion. In this latter regard the needle plate (or fingers), or the forward part only of the needle plate, may be arranged to pivot downwardly in an anti-clockwise direction (as seen in the drawing) to a position in which the fingers underlie the hooks in the forward or loop engaging position of the latter; alternatively the needle plate (or fingers) may be mounted for pivotal motion about a remote axis and in a clockwise direction (as seen in the drawing) away from the path of movement of the needles.

Having thus set forth the nature of the invention, what is claimed herein is:

1. In a tufting machine, means including spaced fingers for supporting a moving backing material, a yarn-carrying needle supported on one side of said backing material, means for reciprocating the needle for penetrating the backing material and forming loops therein, a hook disposed on the opposite side of said backing material from said needle, and means for oscillating said hook toward and away from the path of said needle in timed relationship with the needle reciprocation for seizing said loops in succession, wherein the improvement comprises, means for oscillating said fingers in timed relationship with said hook from a disposition in the path of needle reciprocation for supporting said material during penetration thereof to a disposition withdrawn from said path as said hook moves toward said path.

2. In a tufting machine as recited in claim 1 wherein said machine comprises a plurality of laterally spaced needles and a hook cooperating with each needle, said fingers lying in the plane of needle reciprocation during needle penetration and thereafter being withdrawn from said plane.

3. In a tufting machine as recited in claim 2 including a knife cooperating with each hook for cutting loops of yarn seized and retained thereon.

4. In a tufting machine as recited in claim 1, wherein said fingers oscillate in opposition to said hook.

5. In a tufting machine as recited in claim 2, wherein said means for oscillating said hooks includes means for oscillating said fingers.

6. In a tufting machine as recited in claim 2 wherein said means for oscillating said hooks include a first rocker arm, means for journally mounting said first rocker arm for oscillation, and means for oscillating said rocker arm in timed relationship with said needles, and wherein said means for oscillating said fingers comprised a second rocker arm, means for supporting said fingers on said second rocker arm, means for journally mounting said second rocker arm, and means for driving said second rocker arm from said first rocker arm.

7. In a tufting machine as recited in claim 6, wherein said means for journally mounting said first and second rocker arms comprises a common rock shaft, said means for driving said second rocker arm comprising means for clamping each of said rocker arms to said shaft.

8. In a tufting machine as recited in claim 3, wherein each of said hooks comprise a bill for holding a seized loop to be cut, said bill having an upper surface disposed during loop seizure is substantially the same plane as the plane of backing material support of said fingers.

9. A method of tufting comprising, feeding a backing material for movement through a tufting machine, driving a needle to penetrate and stitch a yarn continuously through said backing material as said material moves to form successive yarn loops on one side of said material, supporting upon said one side of said material an oscillating hook for cooperation with said needle to seize successive loops, supporting said backing material on support fingers on said one side as said needle penetrates said material from the other side, and moving said fingers from a disposition in the path of needle penetration to a disposition removed from said path as the hook moves toward loop seizure.

10. In the method as recited in claim 9, wherein the step of moving said fingers comprises oscillating said fingers in timed relationship with said hook.

11. In the method as recited in claim 10, wherein said hook includes a free end pointing oppositely to the direction of material feed, and including the step of severing each loop retained on said hook.

* * * * *